US007343910B2

(12) United States Patent
Tocheniuk

(10) Patent No.: US 7,343,910 B2
(45) Date of Patent: Mar. 18, 2008

(54) HEATER FASHIONED FROM A ROCK

(76) Inventor: Kenneth Philip Tocheniuk, 1635 Hess Road, Gabriola Island, British Columbia (CA) V0R 1X0

( * ) Notice: Subject to any disclaimer, the term of this patent is extended or adjusted under 35 U.S.C. 154(b) by 177 days.

(21) Appl. No.: 11/146,452

(22) Filed: Jun. 7, 2005

(65) Prior Publication Data

US 2006/0141411 A1 Jun. 29, 2006

(30) Foreign Application Priority Data

Dec. 24, 2004 (CA) ..... 2489917

(51) Int. Cl.
*B28D 1/00* (2006.01)

(52) U.S. Cl. ..... 125/1; 125/12

(58) Field of Classification Search ..... 125/13.01, 125/1, 12; 431/125, 126
See application file for complete search history.

(56) References Cited

U.S. PATENT DOCUMENTS 4,754,852 A * 7/1988 Mule et al. ..... 181/149
5,078,815 A * 1/1992 Othon ..... 156/63
2005/0065260 A9* 3/2005 Kolarik ..... 524/443
2005/0161985 A1* 7/2005 Austin ..... 297/180.12

OTHER PUBLICATIONS

Granite Stone Lanterns for Japanese Gardens, Gifts, Garden Lights, Garden Ornaments., http://www.granitesculpture.com/lanterns.htm (web pages), Noble House and Garden, pp. 6.
Japanese Lanterns, Bamboo Fences, http://www.cherryblossomgardens.com/cgranite.htm (web page), © 1997-2004, p. 1.
Carved Stone Lanterns (J&G Garden Stone—carved stone lanterns, http://www.jggarden.com/Lantern%20A.htm (web pages), J&G Garden Stone, pp. 3.

* cited by examiner

*Primary Examiner*—Dung Van Nguyen
(74) *Attorney, Agent, or Firm*—Davis Bujold & Daniels, P.L.L.C.

(57) ABSTRACT

A method of fashioning a heater from a rock. A first step involves providing a rock having an exterior surface. A second step involves cutting the rock into at least two segments that are capable of being reassembled to reform the rock and maintained in the reassembled condition by force of gravity. A third step involves forming a interior cavity in at least one of the segments. The cavity is spaced inwardly from the exterior surface of the rock and is adapted to conceal a heat source, such as a candle, when the segments are reassembled. A fourth step involves reassembling the segments to reform the rock.

4 Claims, 5 Drawing Sheets

HEATER FASHIONED FROM A ROCK

This application claims priority from Canadian Application Ser. No. 2,489,917 filed Dec. 24, 2004.

FIELD OF THE INVENTION

The present invention relates to a heater fashioned from a rock and a method of making the same.

BACKGROUND OF THE INVENTION

Rocks have previously been adapted for use as candle holders. This was done by drilling a blind bore into a rock, the inner diameter of which was just slightly larger that the outer diameter of a candle. The candle was then inserted into the blind bore, protruding upwardly from the rock. The depth of the blind bore was just sufficient to maintain the candle erect, leaving the balance of the candle exposed.

SUMMARY OF THE INVENTION

According to one aspect of the present invention there is provided a method of fashioning a heater from a rock. A first step involves providing a rock having an exterior surface. A second step involves cutting the rock into at least two segments that are capable of being reassembled to reform the rock and maintained in the reassembled condition by force of gravity. A third step involves forming a interior cavity in at least one of the segments. The cavity is spaced inwardly from the exterior surface of the rock and is adapted to conceal a heat source when the segments are reassembled. A fourth step involves reassembling the segments to reform the rock.

According to another aspect of the present invention there is provided a heater fashioned from a rock, which includes a body formed of a rock, which has been cut into segments and reassembled to reform the rock. The segments are maintained in the reassembled condition by force of gravity. At least one of the segments has an interior cavity spaced inwardly from an exterior surface of the rock and adapted to conceal a heat source when the segments are reassembled.

In some embodiments, the above described heater may also be used as a source of light. It is envisaged that this will be primarily background or mood lighting, to give added ambiance to a room.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
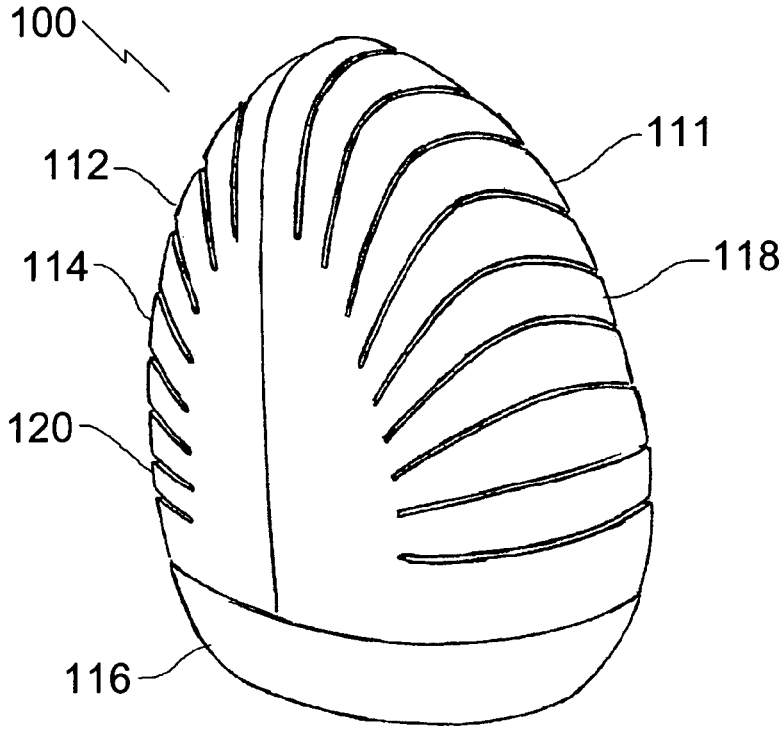
FIG. 1 is a perspective view of a first embodiment of heater fabricated in accordance with the teachings of the present invention.
Figure 2:
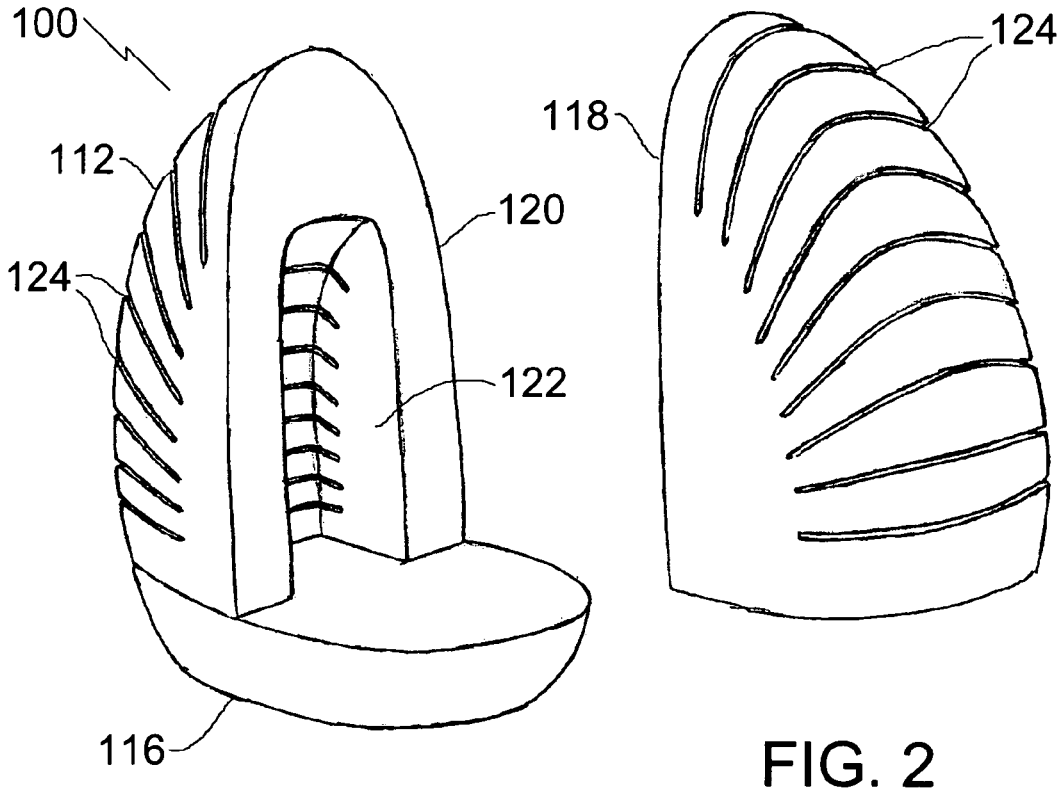
FIG. 2 is an exploded perspective view of the heater illustrated in FIG. 1.

Referring to FIG. 1, a preferred method of fashioning a heater 100 from a rock 112 will now be described. A first step involves providing rock 112 having an exterior surface 114. Referring to FIG. 2, a second step involves cutting rock 112 into segments. In this embodiment, three segments have been illustrated a bottom slab segment 116, a right side segment 118 and a left side segment 120. It is to be noted that bottom slab segment 116, right side segment 118 and left side segment 120 are capable of being reassembled to reform rock 112, as is illustrated in FIG. 1. Bottom slab segment 116, right side segment 118 and left side segment 120 are maintained in the reassembled condition solely by force of gravity. A third step involves forming a interior cavity 122 in at least one of the segments. In this embodiment, interior cavity 122 has been made in both left side segment 120 and right side segment 118; although interior cavity 122 in right side segment 118 is not visible due to the angle from which the perspective view has been taken. It is noted that cavity 122 is spaced inwardly from exterior surface 114 of rock 112 and is adapted to conceal a heat source (not shown) when the segments (116, 118 and 120) are reassembled. The preferred heat source is a candle or candles. Best results have been obtained through the use of tea candles. When one or more tea candles are used, flow passages must be provided for supplying combustion air to cavity 122 when the segments (116, 118 and 120) are reassembled. In this embodiment, the flow passages are a plurality of slots 124, that extend from exterior surface 114 through to cavity 122. It will be appreciated that not all heat sources require combustion air. Referring to FIG. 1, a fourth step involves reassembling the segments (116, 118 and 120) to reform rock 112.

Referring to FIG. 1, the resulting heater 100 includes a body 111 formed of rock 112, which has been cut into segments (116, 118 and 120) and reassembled to reform rock 112. Segments (116, 118, and 120) are maintained in the reassembled condition solely by force of gravity.

Referring to FIG. 2, right side segment 118 and left side segment 120 both have interior cavity 122 spaced inwardly from exterior surface 114 of rock 112 and adapted to conceal a candle (not shown) when the segments (116, 118 and 120) are reassembled. Flow passages, in the form of slots 124, are provided in body 111 for supplying combustion air to cavity 122, when segments (116, 118 and 120) are reassembled.

Variations:

The aesthetic appearance of heaters made in accordance with the teachings of the present method can vary. A number of variations will, therefore, be described to emphasize that although their appearance varies, they still are made in accordance with the teachings of the present method.

Figure 3:
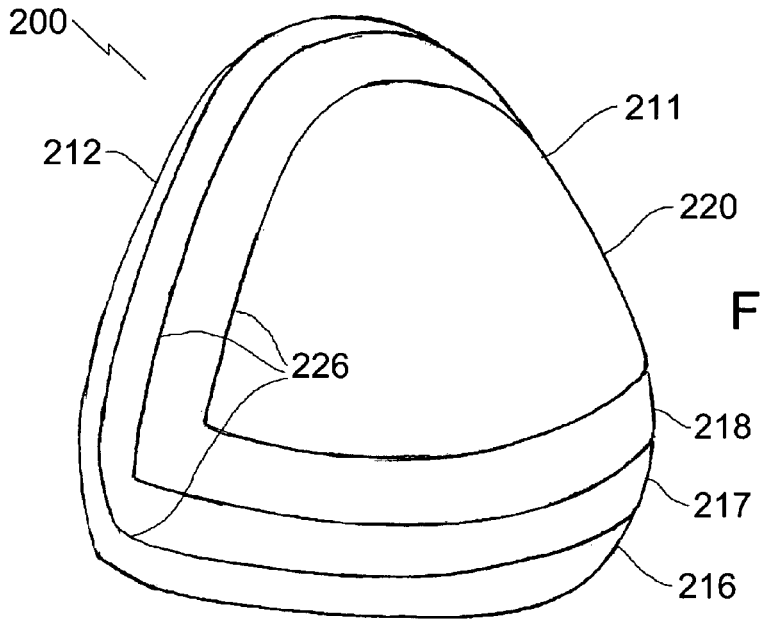
FIG. 3 is a perspective view of a second embodiment of heater fabricated in accordance with the teachings of the present invention.
Figure 4:
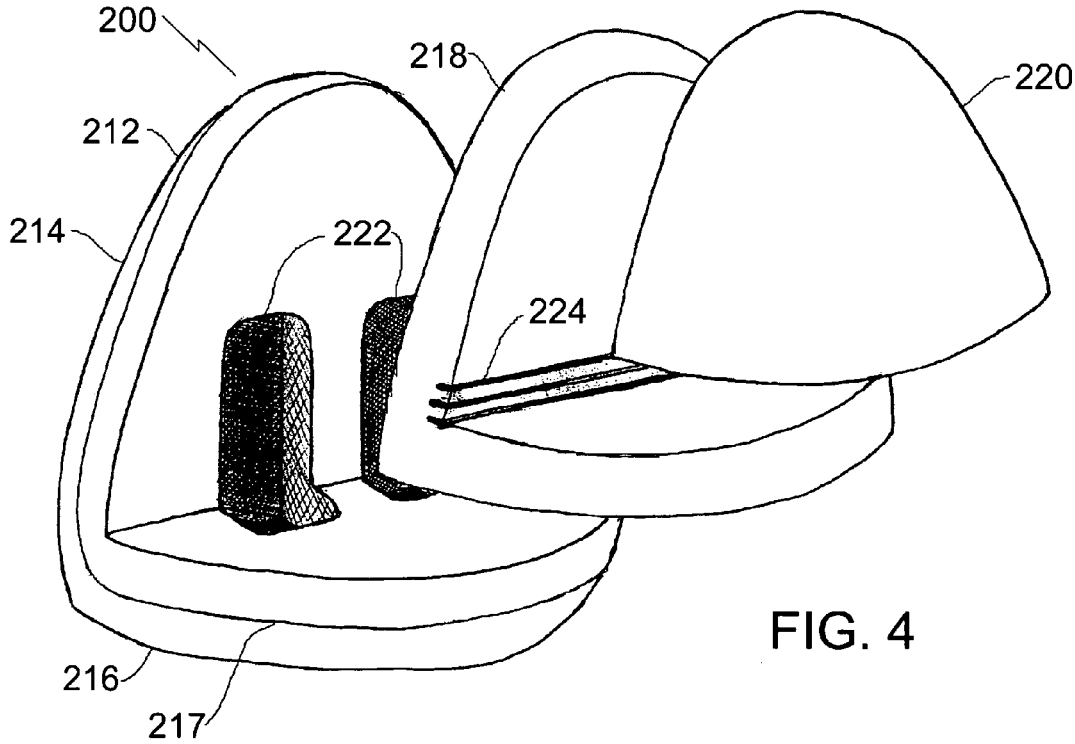
FIG. 4 is an exploded perspective view of the heater illustrated in FIG. 2.

Referring to FIG. 3, a second embodiment of heater, generally identified by reference numeral 200, is illustrated. Heater 200 has a body 211 formed of rock 212, which has been cut into segments and reassembled to reform rock 212. However, in this embodiment there are four segments: a first L-shaped segment 216, a second L-shaped segment 217 which is adapted to nest with first L-shaped segment 216, a third L-shaped segment 218 which is adapted to nest with second L-shaped segment 217 and a wedge-shaped completion segment 220. As with the first embodiment, segments (216, 217, 218, and 220) are maintained in the reassembled condition solely by force of gravity. Referring to FIG. 4, second L-shaped segment 217 has two interior cavities 222 spaced inwardly from exterior surface 214 of rock 212 and adapted to conceal a candle (not shown) when the segments (216, 217, 218 and 220) are reassembled. Flow passages are provided in body 211 for supplying combustion air to cavity 222, when segments (216, 217, 218 and 220) are reassembled. In this embodiment, flow passages take more than one form. The Flow passages include slots 224, which extend through third L-shaped segment 218. The flow passages also include gaps 226 between the segments (216, 217, 218, and 220). Air passes in gaps 226 between the segments (216, 217, 218, and 220). Slots 224 allow air to pass from gap 226 between third L-shaped segment 218 and wedge-shaped completion segment 220, to cavity 222.

Figure 5:
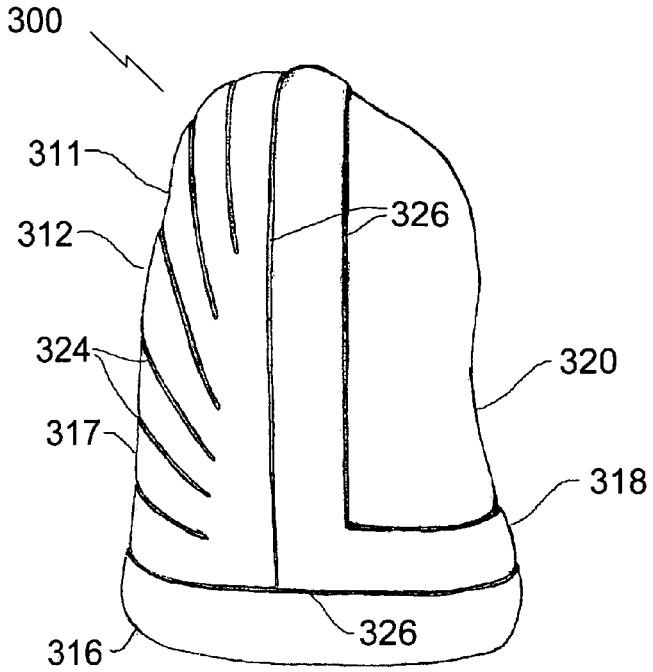
FIG. 5 is a perspective view of a third embodiment of heater fabricated in accordance with the teachings of the present invention.
Figure 6:
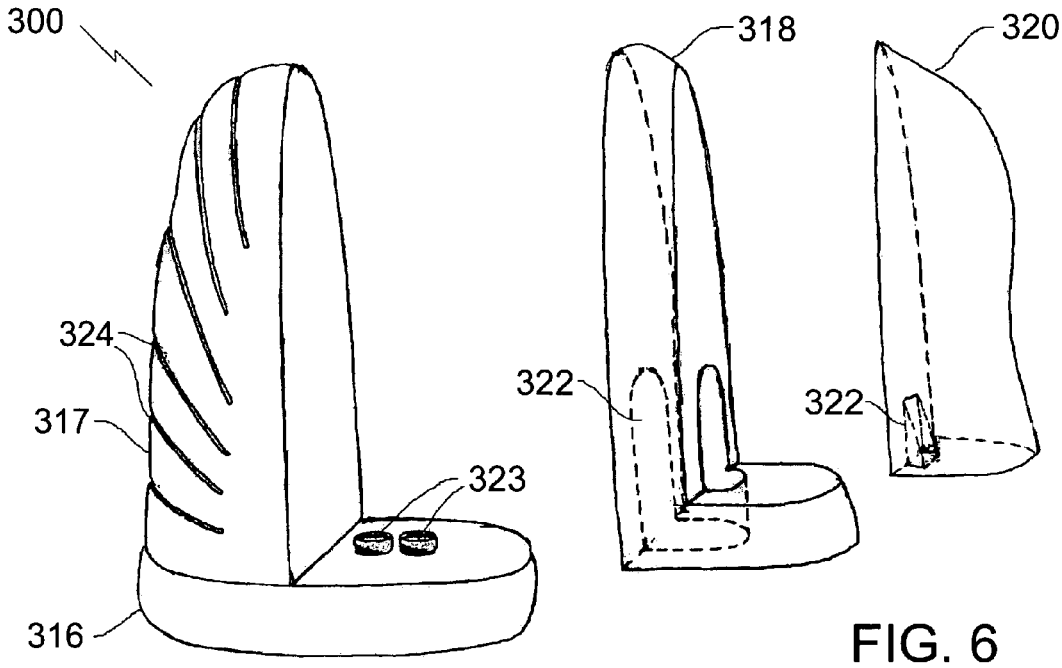
FIG. 6 is an exploded perspective view of the heater illustrated in FIG. 5.

Referring to FIG. 5, a third embodiment of heater, generally identified by reference numeral 300, is illustrated. Heater 300 has a body 311 formed of rock 312, which has been cut into segments and reassembled to reform rock 312. In this embodiment there are four segments: a bottom slab segment 316, a left side segment 317, an L-shaped segment 318 which is adapted to nest with bottom slab segment 316 and left side segment 317, and a right side segment 320. As with the first and second embodiments, segments (316, 317, 318, and 320) are maintained in the reassembled condition solely by force of gravity. Referring to FIG. 6, L-shaped segment 318 has an interior cavity 322 spaced inwardly from exterior surface 314 of rock 312 and adapted to conceal candles 323 when the segments (316, 317, 318 and 320) are reassembled. Flow passages are provided in body 311 for supplying combustion air to cavity 322, when segments (316, 317, 318 and 320) are reassembled. In this embodiment, flow passages only one form. The flow passages are along gaps 326 between the segments (317, 318, and 320). Although slots 324 are shown on left side segment 317, they are merely decorative in this embodiment.

Figure 7:
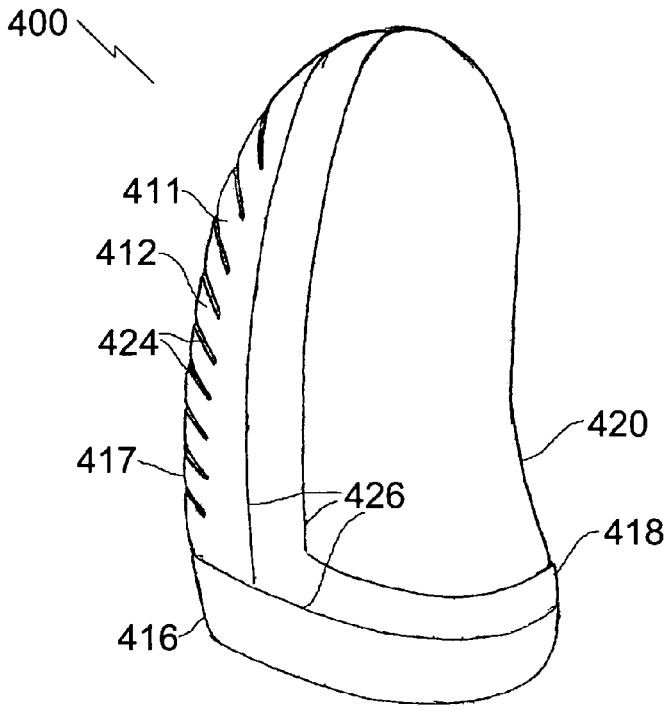
FIG. 7 is a perspective view of a fourth embodiment of heater fabricated in accordance with the teachings of the present invention.
Figure 8:
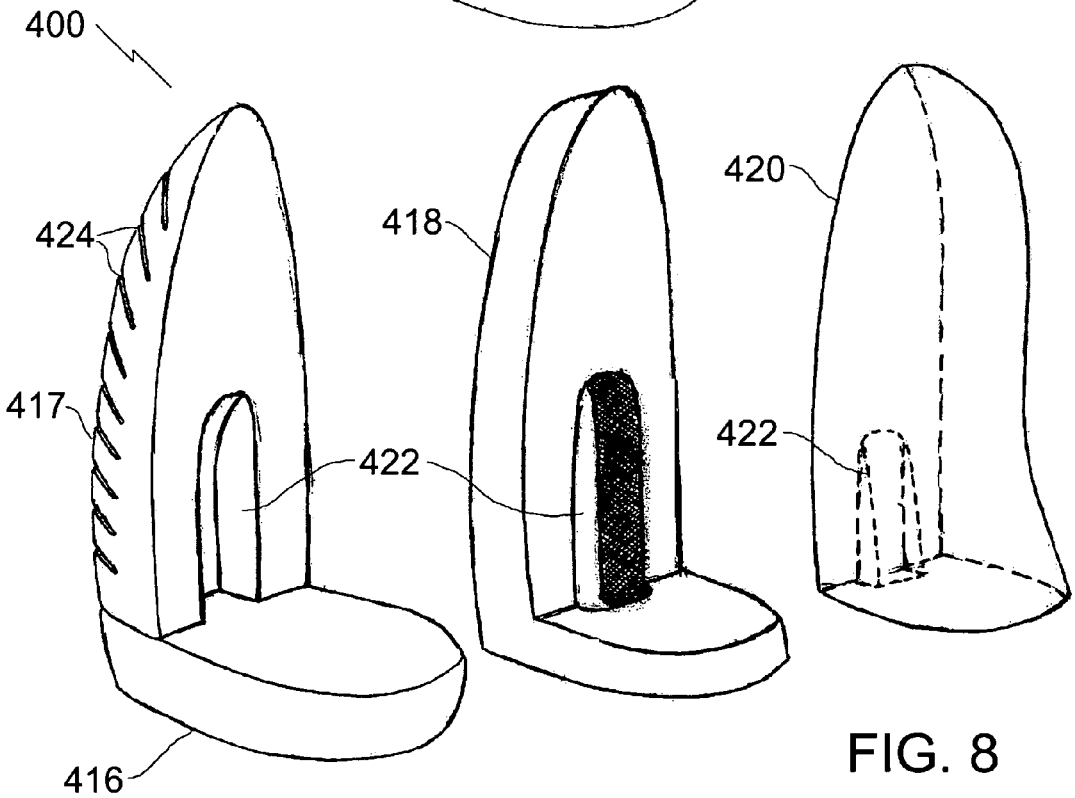
FIG. 8 is an exploded perspective view of the heater illustrated in FIG. 7.

Referring to FIG. 7, a fourth embodiment of heater, generally identified by reference numeral 400, is illustrated. Heater 400 has a body 411 formed of rock 412, which has been cut into segments and reassembled to reform rock 412. In this embodiment there are four segments: a bottom slab segment 416, a left side segment 417, an L-shaped segment 418 which is adapted to nest with bottom slab segment 416 and left side segment 417, and a right side segment 420. As with the first and second embodiments, segments (416, 417, 418, and 420) are maintained in the reassembled condition solely by force of gravity. Referring to FIG. 8, left side segment 417, L-shaped segment 418 and right side segment 420 all have an interior cavity 422 spaced inwardly from exterior surface 414 of rock 412 and adapted to conceal a candle (not shown) when the segments (416, 417, 418 and 420) are reassembled. Flow passages are provided in body 411 for supplying combustion air to cavity 422, when segments (416, 417, 418 and 420) are reassembled. In this embodiment, the flow passages are along gaps 426 between the segments (417, 418, and 420). However, in addition, slots 424 shown on left side segment 417 serve as flow passages as they communicate with interior cavity 422.

Figure 9:
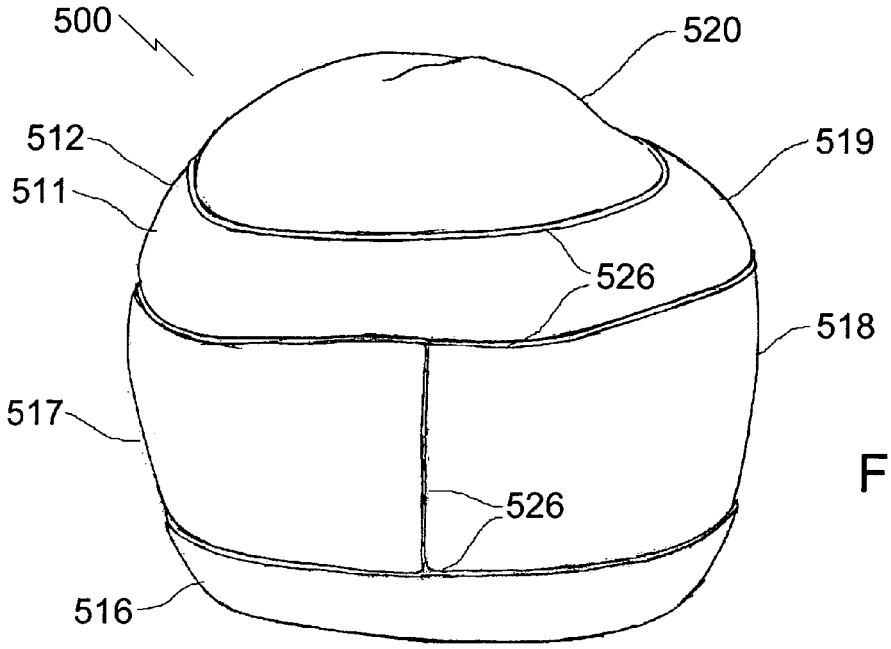
FIG. 9 is a perspective view of a fifth embodiment of heater fabricated in accordance with the teachings of the present invention.
Figure 10:
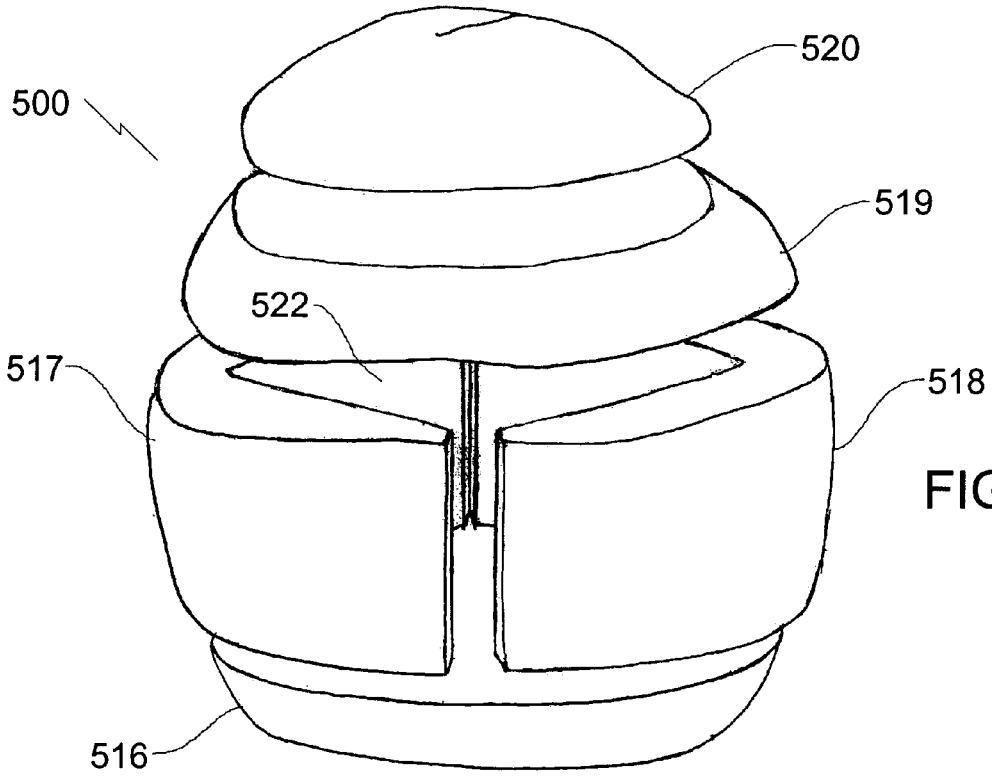
FIG. 10 is an exploded perspective view of the heater illustrated in FIG. 9.

Referring to FIG. 9, a fifth embodiment of heater, generally identified by reference numeral 500, is illustrated. Heater 500 has a body 511 formed of rock 512, which has been cut into segments and reassembled to reform rock 512. In this embodiment there are five segments: a bottom slab segment 516, a left side semi-circular segment 517, a right side semi-circular segment 518, an overlying slab segment 519 and a top cap segment 520. As with the first and second embodiments, segments (516, 517, 518, 519 and 520) are maintained in the reassembled condition solely by force of gravity. Referring to FIG. 10, an interior cavity 522 has been hollowed out and is defined by left side semi-circular segment 517 and right side semi-circular segment 518. Interior cavity 522 is spaced inwardly from exterior surface 514 of rock 512 and adapted to conceal one or more candles (not shown) when the segments (516, 517, 518 519 and 520) are reassembled. Flow passages are provided in body 511 for supplying combustion air to cavity 522, when the segments (516, 517, 518, 519 and 520) are reassembled. In this embodiment, the flow passages are gaps 526 between the segments. Primarily gaps between left side segment 517 and right side segment 518.

Those embodiments which have slots communicating directly with the internal cavity are capable of being used primarily as a source of light. It is envisaged that this will be primarily background or mood lighting, to give added ambiance to a room. As a general rules, the larger the internal cavity, the greater the number of tea candles which can be fit into the cavity, and the greater the potential for generating heat.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of fashioning a heater from a rock, comprising the steps of:

providing a rock having an exterior surface;

cutting the rock into at least two segments that are capable of being reassembled to reform the rock and maintained in the reassembled condition by force of gravity;

forming a interior cavity in at least one of the segments, the cavity being spaced inwardly from the exterior surface of the rock and being adapted to conceal a candle when the segments are reassembled;

cutting flow passages in the rock for supplying combustion air to the cavity when the segments are reassembled; and reassembling the segments to reform the rock.

2. A heater fashioned from a rock, comprising:

a body formed of a rock, which has been cut into segments and reassembled to reform the rock, the segments being maintained in the reassembled condition by force of gravity;

at least one of the segments having an interior cavity spaced inwardly from an exterior surface of the rock and adapted to conceal a candle when the segments are reassembled; and flow passages in the body for supplying combustion air to the cavity when the segments are reassembled.

3. The heater as defined in claim 2, where the flow passages in the body for supplying combustion air are gaps between the segments that access the cavity.

4. The heater as defined in claim 2, wherein the flow passages in the body for supplying combustion air are slots through the body communicating with the cavity.

* * * * *